US006640895B2

(12) United States Patent
Murray

(10) Patent No.: US 6,640,895 B2
(45) Date of Patent: Nov. 4, 2003

(54) EXPANDABLE TUBING JOINT AND THROUGH-TUBING MULTILATERAL COMPLETION METHOD

(75) Inventor: Douglas J. Murray, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 68 days.

(21) Appl. No.: 09/898,794

(22) Filed: Jul. 3, 2001

(65) Prior Publication Data

US 2002/0011339 A1 Jan. 31, 2002

Related U.S. Application Data

(60) Provisional application No. 60/216,823, filed on Jul. 7, 2000.

(51) Int. Cl.[7] ..... E21B 17/00

(52) U.S. Cl. ..... 166/242.6; 166/217; 166/313; 166/50; 166/380; 166/382

(58) Field of Search ..... 166/242.6, 206, 166/207, 380, 386, 382, 217, 50, 313

(56) References Cited

U.S. PATENT DOCUMENTS

| | | | | |
|---|---|---|---|---|
| 4,664,189 A | | 5/1987 | Wittrisch | 166/250 |
| 5,282,509 A | | 2/1994 | Schurr, III | 166/311 |
| 5,992,524 A | * | 11/1999 | Graham | 166/117.6 |
| 6,065,543 A | * | 5/2000 | Gano et al. | 166/117.6 |
| 6,070,671 A | * | 6/2000 | Cumming et al. | 166/206 |
| 6,263,968 B1 | * | 7/2001 | Freeman et al. | 166/207 |
| 6,374,918 B2 | * | 4/2002 | Roberts et al. | 166/191 |
| 6,415,863 B1 | * | 7/2002 | Hudson et al. | 166/208 |

FOREIGN PATENT DOCUMENTS

| | | |
|---|---|---|
| GB | 2329918 A | 4/1999 |
| GB | 2350137 A | 11/2000 |
| WO | WO 00/70183 A1 | 11/2000 |

* cited by examiner

*Primary Examiner*—David Bagnell
*Assistant Examiner*—Robert D. Jones
(74) *Attorney, Agent, or Firm*—Cantor Colburn LLP

(57) ABSTRACT

A through-tubing multilateral system for downhole oil drilling operations includes a tubing extension positioned in a downhole end of a tubing string in a wellbore and an anchoring system configured and positioned to anchor the tubing extension in the wellbore. The tubing extension is dimensioned to accommodate the installation of a multilateral junction therein and has an outside diameter that is less than an inside diameter of the tubing string. The tubing extension has a body portion configured to be tubular in structure and a thin walled section attached to one end of the body portion. The thin walled section has a wall thickness that is less than a wall thickness of the body portion. A method of extending the tubing string in the wellbore includes running the tubing extension into the tubing string such that an uphole end of the tubing extension is overlapped by the downhole end of the tubing string, expanding the tubing extension such that the tubing extension is secured in position by the tubing string, and anchoring the tubing extension in the wellbore.

17 Claims, 2 Drawing Sheets

EXPANDABLE TUBING JOINT AND THROUGH-TUBING MULTILATERAL COMPLETION METHOD

CROSS REFERENCE TO RELATED APPLICATIONS

This application claims the benefit of an earlier filing date from U.S. Provisional Application Serial No. 60/216,823 filed Jul. 7, 2000, the entire disclosure of which is incorporated herein by reference.

BACKGROUND

A large number of single vertical bore oil wells exist in mature or maturing oil fields where the use of multilateral junctions in the vertical bores would allow additional reserves of oil or gas to be accessed. In areas where surface locations are limited, for example, in offshore drilling operations or drilling on the North Slope of Alaska, a multilateral junction from an existing wellbore is desirable however, cost often proves to be a limiting factor in the incorporation of multilateral junctions into the existing wellbores.

Conventional wellbores typically comprise a casing of either steel or concrete and a tubing string concentrically positioned therein, through which oil and gas are removed from subsurface reservoirs.

In one prior art application, the incorporation of a multilateral junction into an existing wellbore involves the removal of the tubing string within the wellbore to allow full bore access to the interior surface of the casing to create exit windows in the casing for lateral drilling operations. Such removal of the tubing string is an expensive and laborious undertaking.

In another prior art application, where the multilateral junction is to be installed at a location below the depth of a terminus of the original tubing string, the tools to be used to create the multilateral junction must be run through the smaller ID tubing and then must be used in the larger ID casing. In such an instance, the centralization of tools and the ability to retrieve the tools through the narrower tubing become issues.

SUMMARY

A through-tubing multilateral system and method for installing the same for downhole oil drilling operations includes a tubing extension positioned in a downhole end of a tubing string in a wellbore and anchored in place. The tubing extension is dimensioned to obtain the most minimal tubing restriction possible such that it facilitates the installation of a multilateral junction therethrough.

The tubing extension of the through-tubing multilateral system includes a main body portion and thin walled section. The thin walled section is attached to an uphole edge of the body portion. The thickness of the wall of the thin walled section is less than the thickness of the wall of the body portion in order to allow for a lesser reduction in the ID of the string at the juncture between the original tubing string and the extension tubing. The tubing extension overall has an outside diameter less than an inside diameter of the tubing string (and any restrictions in the original tubing string) and is installed in direct contact with an inner surface of the downhole end of the tubing string. The juncture between the thin walled section and the tubing string is swaged to smooth the intersection between the original tubing string and the extension string.

The extension tubing string is anchorable by cementing the annulus or installing an inflatable or collapsible packer or similar device.

One advantage of this system and process is that only one set of equipment is needed for a particular size of tubing string. The tools used for each particular size of tubing string are, therefore, independent of the bore diameter defined by the interior surface of the casing. Another advantage of the system is its ability to enable the multilateral junction to be installed from within the tubing string rather than in the wider area of the casing below the tubing string. In addition to the ease of working within the tubing string as opposed to below the downhole end of the tubing string, the system offers considerable savings over removing the tubing string from the wellbore and installing a multilateral junction in a conventional manner, especially in remote locations.

DETAILED DESCRIPTION

A through-tubing multilateral system for an existing oil well where a multilateral junction is desired at a location below the downhole end of an installed tubing string is disclosed. The system involves extending the downhole end of the tubing string in the casing of the bore to install a multilateral junction through the extended tubing string wall from the inside of the tubing string by creating an exit window through the tubing string, traversing the annulus between the tubing string and the casing, and through the casing wall. Lateral drilling can then be performed and a new completion extended into a gas and/or oil formation.

Figure 1:
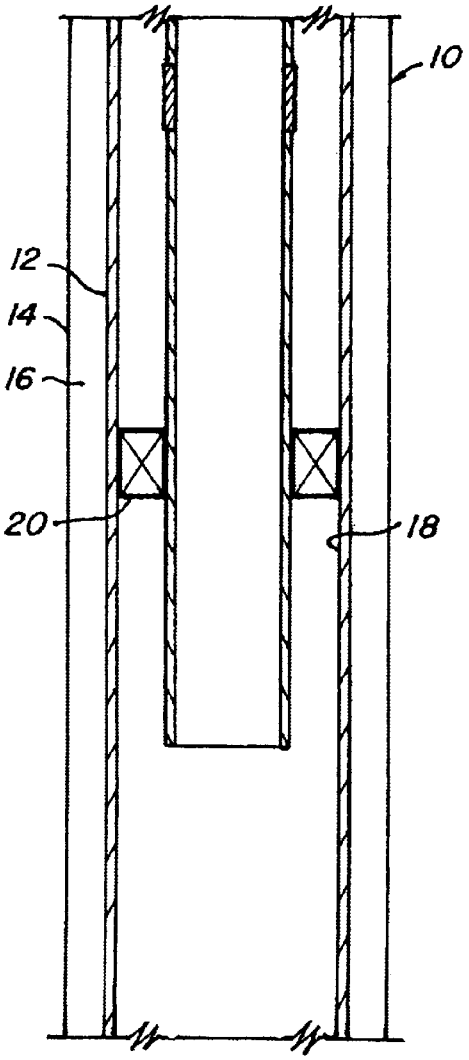
FIG. 1 is a side sectional view of a wellbore in which a tubing string is concentrically disposed within a casing, and wherein the casing extends beyond a terminus of the tubing string.

Referring to FIG. 1, a conventional wellbore is shown generally at 10 and is hereinafter referred to as "bore 10". Bore 10 comprises a tubing string, shown generally at 12, concentrically supported within a casing 14 to form an annulus 16 therebetween. Typically, a completed wellbore includes either 5½ inch diameter tubing inside a 9⅝ inch diameter casing or 4½ inch diameter tubing inside a 7 inch diameter casing. Tubing string 12 is supported within casing 14 by a packer 20. In an uninflated or collapsed state, each of a plurality of packers 20 is inserted into annulus 16 at various places along the length of bore 10. Inflation or expansion of packer 20 holds tubing string 12 relatively concentrically positioned within casing 14 and takes up any clearance between liner 18 and the outer surface of tubing string 12.

Various types of devices are often positioned within annulus 16 to monitor the flow of gas or oil within tubing string 12. These devices typically traverse the wall of tubing string 12 and protrude into the space defined by the ID of tubing string 12. Depending upon the size of the protrusion into tubing string 12, the flow of gas and oil may be somewhat restricted. These devices typically include flow control nipples (not shown) or safety valve nipples (not shown). Prior to the incorporation of the through-tubing multilateral system, such devices should be removed or milled out from the interior of the tubing to make the cross sectional area of tubing string 12 as large and unrestricted as possible.

Figure 2:
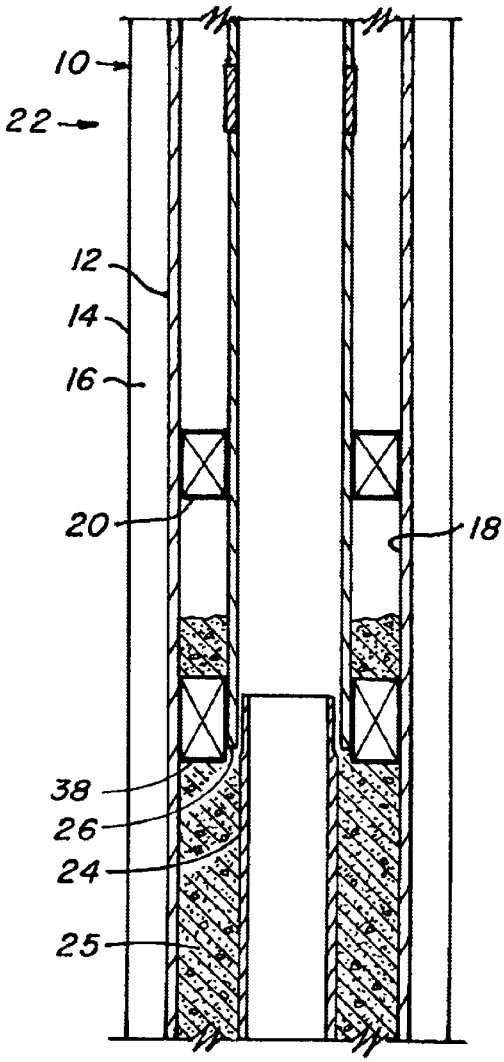
FIG. 2 is a side sectional view of a wellbore in which the tubing string is concentrically disposed within the casing, and wherein the tubing string is extended and anchored within the wellbore.

Referring now to FIG. 2, a through-tubing multilateral system is illustrated generally at 22 and is installed in bore 10. Through-tubing multilateral system 22 comprises tubing string 12 concentrically supported in casing 14, as in FIG. 1. However, through-tubing multilateral system 22 further includes a tubing extension, shown generally at 24, through which the multilateral junction can be installed without centralizers. It is desirable to anchor the extension with a form of anchoring system which may be by cementing the annulus around the extension, which incidentally also provides for zonal isolation, or may be by expandable or inflatable packers, etc. To create a multilateral junction utilizing through-tubing multilateral system 22, tubing extension 24 is run through tubing string 12 such that tubing extension 24 extends beyond a terminus 26 of tubing string 12 but overlaps tubing string 12 slightly at terminus 26. The final depth of tubing of the tubing extension 24 should be deeper in bore 10 than the level at which any multilateral junction is likely to be installed. Because tubing extension 24 is run into bore 10 through tubing string 12, it must have an outside diameter that is smaller than an inside diameter of the tightest restriction in the tubing string 12. In order to gain the greatest effectiveness of the system it is desirable to expand the entire length of the tubing extension with either an inflatable tool or a swage. Additionally the expansion can be done in a single operation or in a number of smaller sections sequentially.

Figure 3:
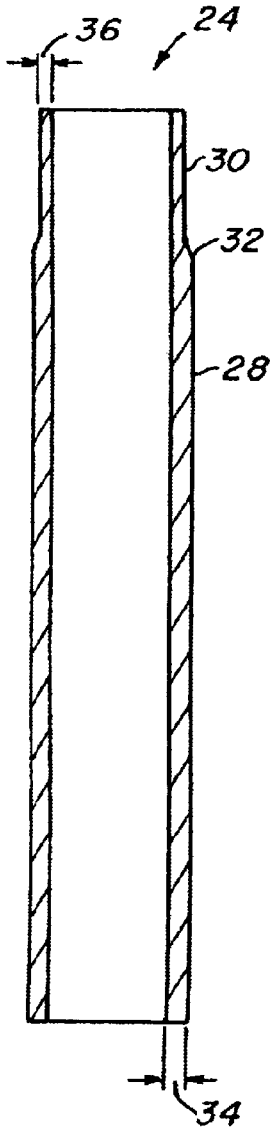
FIG. 3 is a side sectional view of a tubing extension showing a main body portion of a greater wall thickness and a thin walled section.
Figure 4:
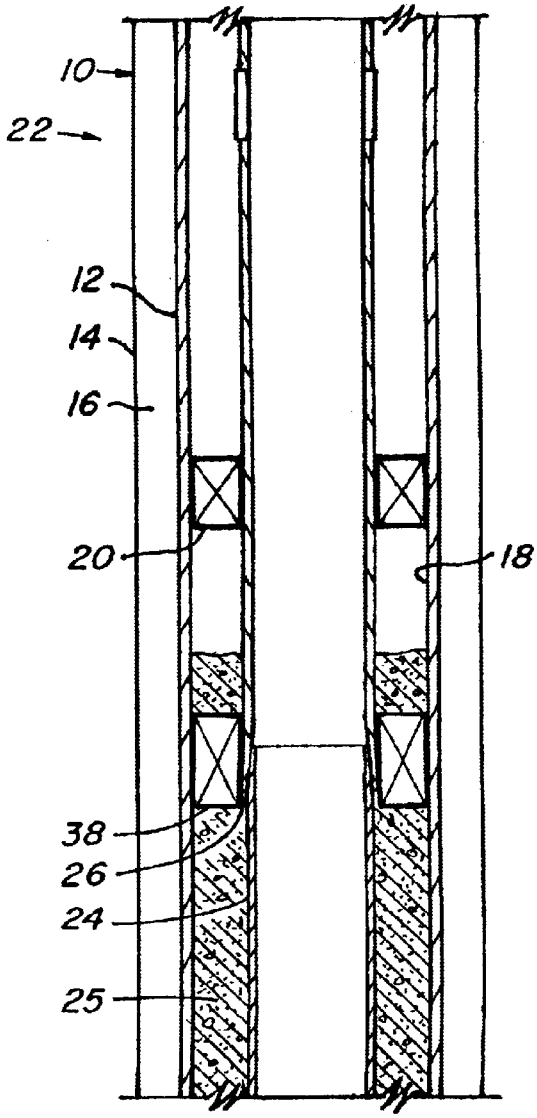
FIG. 4 is an alternate embodiment wherein the tubing extension is expanded in its entirety.

Referring to FIG. 3, tubing extension 24 is shown in greater detail. Tubing extension 24 comprises a main body portion 28 having a thin walled section 30 attached thereto and is oriented in the bore such that thin walled section 30 is "uphole" relative to body portion 28. This is because it is the thin walled section that is intended to be overlapped with the tubing string 12. The thin walled section provides for a smaller restriction at the juncture of tubing string 12 and tubing extension 24. An inner surface of tubing extension 24 is configured to be smooth and relatively free of variations in the region at which thin walled section 30 is attached to main body portion 28. An outer surface of tubing extension 24 is configured to define a shoulder 32 that extends outward from section 30 to main body portion 28 at the point at which the portion 28 and section 30 are joined. Shoulder 32 is configured to define main body portion 28 as having a wall thickness 34 that is substantially equal to the wall thickness of the tubing string 12 and thin walled section 30 as having a wall thickness 36 that is somewhat less than wall thickness 34 of main body portion 28.

Referring to all of the Figures, the overlapping of tubing extension 24 on tubing string 12 causes an aberration in the transition of the inner surfaces between tubing extension 24 and tubing string 12. The aberration is typically a raised ridge formed by section 30 of tubing extension 24 protruding concentrically inwardly from the I.D. of tubing string 12. As stated the thin wall is employed to reduce this effect. In addition, the swaging or expansion operation minimizes this effect farther by expanding the juncture to a diameter significantly enough larger than the size prior to expanding that upon rebound very little restriction is present. In a preferred embodiment, the inside diameter of tubing extension 24 is substantially the same as the minimum restriction in tubing string 12.

Once tubing extension 24 is properly positioned within bore 10, tubing extension 24 is preferably cemented in place with cement 25 before the window and lateral borehole are drilled which acts as a support system. Alternative support systems include packers located around the tubing extension and may be at a juncture of the tubing extension and the tubing string. Cement 25 provides support for the conventional installation of the multilateral junction proximate the point at which tubing string 12 and tubing extension 24 meet. The extension tubing string is anchorable by cementing the annulus or installing an inflatable or collapsible packer or similar device 38. A window in the tubing and the casing is created using standard whipstocks and whipstock anchoring systems (not shown). Multilateral junction can then be installed.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A through-tubing multilateral system for drilling operations, comprising:

a tubing extension positioned at a downhole end of a tubing string in a wellbore, said tubing extension comprising a main body portion and a thin walled section disposed thereat, said thin walled section being thin prior to installing said extension in a wellbore and being the section overlapping the end of the tubing string; and an anchoring system configured and positioned to anchor said tubing extension in said wellbore.

2. The through-tubing multilateral system of claim 1 wherein said tubing extension has an outside diameter less than an inside diameter of said tubing string.

3. The through-tubing multilateral system of claim 1 wherein said thin walled section being positioned at an uphole edge of said body portion.

4. The through-tubing multilateral system of claim 3 wherein said thin walled section is configured to have a thinner wall thickness than said body portion.

5. The through-tubing multilateral system of claim 4 wherein said thin walled section is in interference fit contact with an inner surface of a downhole end of said tubing string to form a juncture of said thin walled section and said tubing string.

6. The through-tubing multilateral system of claim 5 wherein said juncture between said thin walled section and said tubing string is swaged to effectuate a smooth surface between said tubing string and said thin walled section.

7. The through-tubing multilateral system of claim 1 wherein said anchoring system is positioned at an overlapping juncture of said tubing extension and said tubing string.

8. The through-tubing multilateral system of claim 7 wherein said anchoring system is cement.

9. The through-tubing multilateral system of claim 7 wherein said anchoring system is a packer.

10. A tubing extension for downhole oil drilling operations in a wellbore, comprising:

a body portion configured to be tubular in structure; and a thin walled section attached to an end of said body portion, said thin walled section having a wall thickness that is less than a wall thickness of said body portion prior to being installed in a wellbore and wherein said section is necked down from an outside dimension of the tubing extension.

11. The tubing extension of claim 10 wherein said tubing extension is dimensioned to be slidingly received in a tubing string of said wellbore.

12. A method of extending tubing string in a wellbore, comprising:

running a tubing extension into a tubing string in said wellbore such that an uphole end of said tubing extension is overlapped by a downhole end of said tubing string, said extension having a body portion and a lip portion and wherein said lip portion has a thickness less than said body portion prior to being installed in said wellbore and is the section overlapping the end of the tubing string;

expanding said tubing extension such that said tubing extension is secured in position by said tubing string; and anchoring said tubing extension in said wellbore.

13. The method of claim 12 further comprising the milling out of restrictions in said tubing string prior to running in said tubing extension.

14. The method of claim 12 wherein said expanding of said tubing extension comprises the swaging of said tubing extension.

15. The method of claim 12 wherein said anchoring of said tubing extension in said wellbore comprises cementing a juncture of said tubing extension and said tubing string.

16. The method of claim 12 wherein said anchoring of said tubing extension in said wellbore comprises installing a packer around a juncture of said tubing extension and said tubing string.

17. The method of claim 12 wherein said tubing extension is expanded along the entire length thereof.

* * * * *